United States Patent [19]

Jansen-Herfeld

[11] 4,220,035

[45] Sep. 2, 1980

[54] DEVICE FOR THE STRAIGHTENING OF THIN METALLIC PARTS ESPECIALLY SHEETS

[76] Inventor: Röttger Jansen-Herfeld, Königstr. 146, Remscheid, Fed. Rep. of Germany

[21] Appl. No.: 971,873

[22] Filed: Dec. 21, 1978

[30] Foreign Application Priority Data

Dec. 24, 1977 [DE] Fed. Rep. of Germany ..... 2757906

[51] Int. Cl.[3] ..... B21B 37/06

[52] U.S. Cl. ..... 72/413; 72/442; 72/477

[58] Field of Search ..... 72/53, 413, 442, 473, 72/477, 479, 414; 101/18, 29; 10/11 A

[56] References Cited

U.S. PATENT DOCUMENTS

| | | | |
|---|---|---|---|
| 973,807 | 10/1910 | Orsoni | 72/442 |
| 1,112,544 | 10/1914 | McCarroll | 72/442 |
| 1,113,442 | 10/1914 | Irvin | 72/442 |
| 1,519,006 | 12/1924 | Pannier | 101/18 |
| 1,789,831 | 1/1931 | Pannier, Jr. et al. | 101/18 |
| 3,965,716 | 6/1976 | Suzuki et al. | 10/11 A |

*Primary Examiner*—Lowell A. Larson
*Attorney, Agent, or Firm*—Michael J. Striker

[57] ABSTRACT

An arrangement for treating generally planar workpieces has two shafts provided on their endfaces with carriers for sets of tools. These sets can be moved with their carriers so that all tools of each set move relative to a center plane between the endfaces, and any one tool of the respective set can be placed into a position closest to the center plane during such movement of the entire set of tools.

13 Claims, 4 Drawing Figures

DEVICE FOR THE STRAIGHTENING OF THIN METALLIC PARTS ESPECIALLY SHEETS

Figure 1:
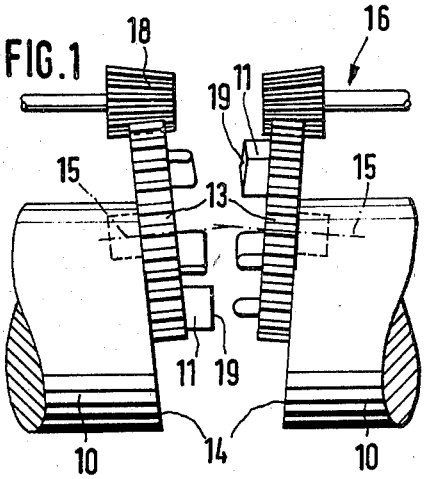

The invention concerns a device for the straightening of thin metallic parts, especially sheets, through local deformation by means of hammering with two tools operating in conjunction and acting upon the work piece suspended between them by impact- and thrust-like movements. The stems of the tools can move relative to each other and are provided with projections which, on one hand are formed in the shape of a hammer peen, and on the other hand are provided with impact surfaces serving as an anvil. Local deformation by hammering is utilized for the straightening of sheets having bulges, indentations, waves etc. For this purpose, the sheet was placed upon a forging anvil and extended locally by working upon it with a hand-held hammer. The hammer peen is applied to achieve stretching in pre-determined directions. This allowed perfect straightening of sheets and thin metallic parts respectively. Straightening requires, however, great expenditure of force, subjecting to great stress the persons performing this work.

Devices have already been developed by which such straightening can be performed mechanically. These devices possess two tools, operating in conjunction and acting upon the work piece suspended between them, by impact- or thrust-like movements. Projections acting upon the work piece are provided at the stems, the stems being movable relative to each other. One projection is formed in the shape of a hammer peen, and the projection provided on the other stem has an impact surface acting as an anvil. One side surface of the work piece is affected by contacting the projection formed as hammer peen, whilst the other side surface is affected by that projection which has an impact surface acting as an anvil. Faultless straightening may, however, in case of need, necessitate turning around of the work piece for several times, so that the differing projections can also act on the respective opposite side surfaces of the work piece. This device requires furthermore tilting of the work piece around a horizontal axis, so that the projection which is formed as hammer peen, can achieve stretching in the direction desired. This device still requires a relatively high amount of manual work by the operator.

The invention is based upon the task of creating a device of the nature as described at the beginning, avoiding these disadvantages and requiring that the work piece to be straightened need be moved only in the direction in which it is to be stretched.

According to the invention, this task is solved by providing both tool stems with projections in the form of a hammer peen, as well as with projections with an impact surface serving as an anvil, whereby these projections can be brought alternatingly into their operating position, and whereby the projection which is in its respective operating position will in it, be the farthest protruding. This will considerably simplify and facilitate the straightening of thin metallic parts, especially sheets, since for the blows that are to be imparted at a given moment, the appropriate tool projections are brought into operating position, and the blows can then be performed. Using the device as intended, will allow, in a simple manner, that only the projection which is placed in operating position and thus protruding farthest in the operating direction, comes into effective contact with the work piece, while the other tool projections stand farther back and will not contact the work piece when the tool stems are moving against each other.

Both tool stems can have respectively one projection with an impact surface serving as an anvil, and several projections in the form of a hammer peen, with different angle positions at the tip of the peens. This allows bringing into operating position, by appropriate setting of the tool projections at both stems which are required in that case, the projection with an impact surface acting as anvil as well as the projections formed as hammer peens with different angles at the peen tips, so that the required work of straightening can be performed in a pariculatly simple manner.

The projections assigned to their respective tool stems, can be arranged in an eccentric circle on one side of a revolving plate which is provided at the front face of the tool stem, and the axle of pivoting of the revolving plate can be inclined relative to the operating direction of the tool stem, the projections being set in the revolving plate at such an angle that a projection which is in operating position, will be pointed in the operating direction of the tool stem. This arrangement of the axle of rotation of the revolving plate, inclined in the operating direction of the tool stem, provides in a particularly simple manner, for the projection that is in operating position to protrude the farthest out, whilst those projections that are not arranged in their operating position will be standing back. The projection which is in operating position needs to protrude beyond the other projections by merely on millimeter, to prevent those projections not in their operating position from coming into contact with the work piece when the device is used as intended.

The rotary axle of the revolving plate can be arranged eccentrically, and the projection arranged in its respective operating position can be arranged centrally, both relative to the tool stem. Thus, the projection arranged in operating position is located centrally to the tool stem, so that the line of effectiveness of the tool stem is maintained and tilting stresses and similar strains are avoided.

Herein, the revolving plate can be provided with a mechanical pivoting device. This will allow in a particularly simple manner, adjusting of the revolving plate and thus setting the desired projection into its operating position.

According to a further idea of this invention, the projections that are respectively assigned to one tool stem, can be retained, like rays, by a pivoting part arranged at the front face of the tool stem, and the pivoting axis of that part will also form the center of these rays and run through the axis of the tool stem. This, too, allows in a simple manner to bring the desired tool projection into its operating position, and that projection arranged in operating position will protrude farthest out in its operating position.

The pivoting part, formed by a cylindrical roller with the projections in a ray-like arrangement, can be made mechanically adjustable. This allows in a particularly simple manner to set the desired tool projection into its operating position.

The projecting parts assigned to their respective tool stem can be arranged adjustable relative to their operating direction, in an eccentric circle on a revolving plate that is provided at the front face of the tool stem and is set so that its axis runs in the operating direction of the tool stem, and, upon application as intended, the projection which is then in its operating position, will protrude farthest out of the revolving plate. By this, the tool projections allow not only pivoting to set them into their operating position, but they will also allow moving in the longitudinal direction, so that upon pivoting the desired projection into its operating position, it is also simultaneously moved forward so that it will protrude beyond the other projections, and thus, on application of the device as intended, the other projections will not come into contact with the work piece.

Those projections which are not in operating position can, with their rear ends, engage sockets within the face of the tool stems, and, on pivoting of the revolving plate, that projection which is to be transferred into the operating position can be transferred, by moving over inclined planes and maintaining a mating fit, into the operating positions. This will automatically cause the longitudinal movement of that projection upon turning of the revolving plate and thus that projection which is in the operating position will protrude beyond the other projections. The sockets within the face of the tool stem can be fitted with an elastic material. On application of the device as intended, all the projections provided on both tool stems will be in effective contact with the work piece undergoing this operation. Transmitting of force onto the work piece, is however, effected here only by that projection which is in operating position, while the other projections merely abut the work piece and, by virtue of the elastic material, do not transmit any impacting effect upon the work piece.

The revolving plate which is pivotable around the same axis with the operating direction of the tool stem, can also be adjustable by mechanical means, in order to effect the desired setting.

It can be of advantage, to press the work piece which is suspended between the two tools, against the stationary tool, and this may be of advantage.

Figure 2:
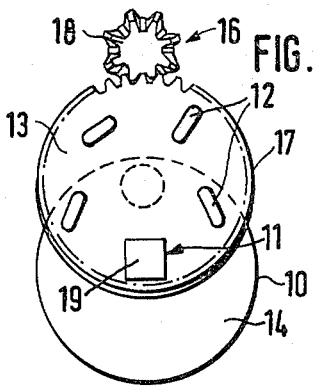
Figure 3:
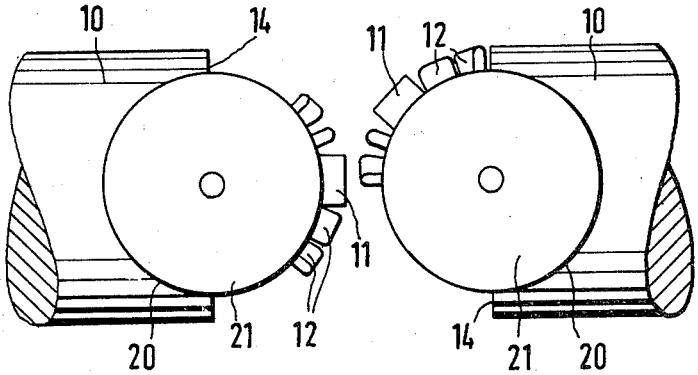
Figure 4:
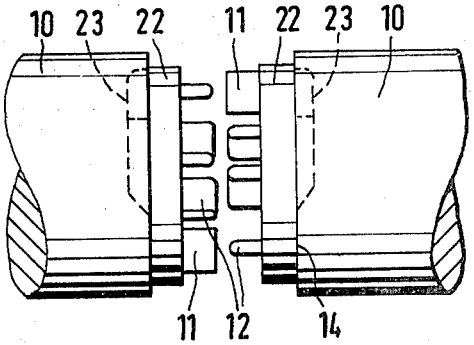

The drawing represents the invention in several examples of the design, showing in:

FIG. 1 A device as per this invention, in side view, partially broken off,

FIG. 2 A top view upon the revolving plate of the device,

FIG. 3 A second design of the device as per this invention, in front view, partially broken off, and FIG. 4 A further design as per this invention in front view, partially broken off.

The devices shown in the drawing serve for the straightening of thin metallic parts, especially sheets, through local deformation, by means of hammering, with two tool stems 10, working in conjunction and acting upon the work piece suspended between them with impact- or thrust-like movements. For the sake of simplicity, only the tool stem 10 and the projections 11 and 12 provided thereon, of the device, are shown. The work piece and the suspension device required for it have also been omitted for the sake of simplicity. The suspension device and the other parts of the device can be of a construction as known. The devices can be designed here in such a manner, that, on using as intended, the tool stem 10 will be moved towards the tool stem 10. Furthermore, it is also possible to design the device in such a manner, that, on using as intended, both tool stems will be moving towards each other. In the device where the one tool stem 10 is arranged stationary, the work piece can be pressed with a pre-determined force against the projections 11 or 12 respectively of the stationary tool stem, which are in their operating position.

In the design example shown in FIGS. 1 and 2, the projections 11, 12 assigned to their respective tool stem 10, are arranged at one side of a revolving plate 13 which is mounted, so that it can pivot, at the front face 14 of tool stem 10. The projections 11, 12 are herein mounted, along an eccentric circle, on the revolving plate 13. The pivoting axle 15 of the revolving plate 13 is running at an inclination to the operating direction of the tool stem 10, wherein the projections 11, 12 are also arranged at the revolving plate 13 at such an inclination, that that projection which is in its respective operating position, will be along the operating direction of the tool stem 10. The pivoting axle 15 of the revolving plate 15 is arranged eccentrical relative to the tool stem, the projection 11, 12 in their respective operating position are arranged centrical relative to the tool stem. Furthermore, the revolving plate 13 is provided with a mechanical pivoting device 16. For this purpose, the revolving plate 13 is provided at its circumference with the gear 17 which is in mesh with the pinion 18. By means of the pivoting device 16, the revolving plate 13 can thus be pivoted around and the desired tool projection 11 and 12 respectively, can be transferred into the operating position. The inclination of the pivoting axle 15 of revolving plate 13 relative to the operating direction of the tool stem 10 serves to have the projection 11 and 12 respectively, to protrude farthest in the direction of their operation, when in their operating position, so that in using the device as intended, only those projections 11 and 12 respectively, which are in their operating position, will be in effective contact with the work piece. The other tool projections 12 and 11 respectively, that are not arranged in the operating position, will not protrude as far in their operating direction, so that these projections 11 and 12 respectively will not be in contact with the work piece. The inclination of the pivoting axle 15 of the revolving plate 13 relative to the operating direction of the tool stem 10, can be designed here very small, as the tool projections 11 and 12 respectively, when in their operating positions, need to protrude beyond the other projections 11 and 12 respectively by only about one millimeter.

As can be seen especially from FIG. 2, a projection 11, having an impact surface acting as an anvil, 19, is arranged on the revolving plate 13. Furthermore, four projections 12, formed in the shape of a hammer peen, are arranged on revolving plate 13. The four hammer-peen-shaped projections 12 are so arranged at the revolving plate 13, that the tips of the peens, after their respective transfer into the operating position, will have angular positions that are at a variance of 45° to each other. When using the device as intended, the hammer-peen-shaped projections 12 will exert thrust- or impact-like movements upon the work piece, and the work piece is supported herein, on its other side, by the projection 11 with the impact area acting as anvil 19. By action of the hammer-peen-shaped projections 12, deformations of the work piece, i.e. stretching along predetermined directions of stretching, will be achieved. One of the four projections 12, which have different angular positions, will be applied, depending upon the desired direction of stretching. The operator can thus set the desired tool projections 11 or 12 respectively, at each of the two tool stems 10, as may be required, and then impart the necessary blows to the work piece.

In the design example shown in FIG. 3, the projections 11, 12 assigned respectively to one tool stem 10, are retained, and extending from it like a bundle of rays, by a pivoting part which is attached to the front face 14 of the tool stem 10. The pivot axis which also forms the center of the rays, is set at a right angle to the operating direction of the tool stem 10. At the front face 14 of the tool stem 10, a trough-shaped recess 20 is provided for the pivoting part formed by the cylindrcal roller 21, the pivoting part having the projections 11, 12 extending from it like rays. This pivoting part formed by the cylindrical roller 21 and having the ray-like extending projections 11, 12, can be mechanically movable in a manner not shown closer. By turning the roller 21, the respectively desired projection 11, 12, can be moved into its operating position in which it will be at the same axis as the operating direction of tool stem 10.

In the design example shown in FIG. 4, the projections 11, 12 assigned respectively to one tool stem 10, are arranged on a revolving plate 22 so that they can be moved along their operating direction. Here the revolving plate 22 is arranged at the front face 14 of the tool stem 10, at the same axis as the operating direction of the tool stem. The availability of longitudinal movement of the projections 11, 12 when pivoting the revolving plate 22 allows for such setting, that only that projection 11 or 12 respectively which is in operating position, will be protruding farthest in the operating direction. To achieve this, those projections 11 and 12 respectively, which are not in operating position, can engage, with their rear ends the sockets 23 of face 14 of the tool stem 10. On pivoting the revolving plate 22, the projection 11 and 12 respectively, which is to be transferred into its operating position, can be so transferred forward into its operating position over inclined planes, not shown here closer, and maintaining a mating fit. Furthermore it is also possible to fit with an elastic material the sockets 23, at the face 14 of tool stem 10, which are provided for the rear ends of those projections 11 and 12 respectively that are not in operating position. This will allow in a simple manner that, on using the device as intended, those projections 11 and 12 which are not in operating position, will abut the working piece but will not, however, through the provision of the elastic material, be able to transmit the required force, so that only the projection 11 or 12, which is without elastic support, will transmit force from the tool stem 10 to the work piece. In this design too, as shown in FIG. 4, mechanical pivoting of the revolving table is possible.

As already noted, the designs as shown are merely examples of realizations of the invention and not limited by these. Many-fold various designs and variations are furthermore possible.

I claim:

1. An arrangement for shaping a generally planar workpiece, comprising a pair of elongated members having juxtaposed endfaces and being movable towards and away from one another with reference to a normal position in which said endfaces are spaced from a plane midway between them and in which a workpiece is to be suspended; a support on each of said members at the endface thereof; a plurality of tools on each support and extending towards said plane; and means mounting each of said supports with the tools thereon for rotation relative to the respective endface, to and from a position in which a selected one of said tools is located closest to said plane while all others of said tools are located farther from said plane so that, when said members move towards one another only the selected tools of the two supports contact a workpiece suspended in said plane.

2. An arrangement as defined in claim 1, wherein at least some of said tools on one support are hammers and at least one tool on the other support is an anvil.

3. An arrangement as defined in claim 2, wherein each tool has a different angle of attack relative to the respective member.

4. An arrangement as defined in claim 2, wherein said supports are plates.

5. An arrangement as defined in claim 4, wherein at least one of said plates is arranged on the respective member eccentrically relative to a longitudinal axis thereof.

6. An arrangement as defined in claim 4, wherein at least one of said plates is rotatable about an axis extending at an angle relative to a longitudinal axis of the respective member.

7. An arrangement as defined in claim 4, wherein each of said plates has a peripheral surface, said tools being installed on the respective peripheral surfaces.

8. An arrangement as defined in claim 4, wherein at least one of said plates is pivotable about a pivot axis extending substantially transverse to the direction of movement of said member towards and away from each other.

9. An arrangement as defined in claim 4, wherein said plates constitute cylindrical rollers.

10. An arrangement as defined in claim 4, and further comprising means for adjusting said tools on the respective plates and relative thereto.

11. An arrangement as defined in claim 10, wherein at least one of said plates is rotatable about an axis substantially parallel to the direction of movement of said member towards and away from each other.

12. An arrangement as defined in claim 10, wherein said adjusting means constitute a recess provided in the respective plate for receiving one end of said tools, the other end of which extends from said respective plate in direction towards another of said plates.

13. An arrangement as defined in claim 12, and further comprising means for elastically supporting all of said tools with the exception of said selected one of said tools to thereby ensure that only said selected one of said tools will actually treat the workpiece.

* * * * *